United States Patent [19]

Weingarten

[11] 4,448,558

[45] May 15, 1984

[54] COMPUTER PRINTER PAPER SUPPORT

[76] Inventor: Joseph L. Weingarten, 1927 Oak Tree Dr. E., Dayton, Ohio 45440

[21] Appl. No.: 502,027

[22] Filed: Jun. 7, 1983

Related U.S. Application Data

[63] Continuation of Ser. No. 300,869, Sep. 10, 1981, abandoned.

[51] Int. Cl.[3] ..... B41J 13/08; B41J 13/12; B41J 13/24

[52] U.S. Cl. ..... 400/529; 400/521; 400/622; 282/11.5 A; 282/DIG. 2

[58] Field of Search ..... 282/15 A, 22 R, 11.5 A, 282/DIG. 2, 11.5 R, 29 R, 29 A, 29 B, 29 C; 281/5; 400/531, 622, 623, 616, 616.2, 521, 529, 530

[56] References Cited

U.S. PATENT DOCUMENTS

| | | | |
|---|---|---|---|
| 1,107,372 | 8/1914 | Smith | 400/531 |
| 2,113,455 | 4/1938 | Sherman | 271/2.4 |
| 2,275,064 | 3/1942 | Moore | 271/2.4 |
| 2,800,214 | 7/1957 | Symonds | 400/529 |
| 3,139,292 | 6/1964 | Swyden | 282/29 |
| 3,484,097 | 12/1969 | Jory | 281/5 |
| 3,544,212 | 12/1970 | Umahashi et al. | 355/42 |
| 3,589,809 | 6/1971 | Barker et al. | 355/17 |
| 3,611,929 | 10/1971 | Schritz et al. | 101/292 |
| 3,618,739 | 11/1971 | Fleischmann | 400/529 |
| 3,627,411 | 12/1971 | Nagel | 355/45 |
| 3,804,226 | 4/1974 | Ellis | 400/531 |
| 4,005,810 | 2/1977 | Porter | 226/6 |
| 4,018,153 | 4/1977 | Freeman | 101/93 |
| 4,046,615 | 9/1977 | Jansen | 156/544 |
| 4,066,206 | 1/1978 | Peterson | 229/69 |
| 4,070,223 | 1/1978 | Stalzer | 400/616.1 |
| 4,071,142 | 1/1978 | D'Luhy | 282/22 R |
| 4,197,799 | 4/1980 | Sato | 101/291 |

FOREIGN PATENT DOCUMENTS

| | | | |
|---|---|---|---|
| 1149726 | 6/1963 | Fed. Rep. of Germany . | |
| 1056432 | 9/1969 | Fed. Rep. of Germany . | |
| 2700668 | 7/1978 | Fed. Rep. of Germany . | |
| 2817277 | 10/1979 | Fed. Rep. of Germany | 282/DIG. 2 |
| 1227652 | 8/1980 | France . | |

OTHER PUBLICATIONS

IBM Technical Disclosure Bulletin, vol. 2, No. 2, (Aug. 1959), Sharp.

*Primary Examiner*—William Pieprz
*Attorney, Agent, or Firm*—Donald J. Singer; Bobby D. Scearce

[57] ABSTRACT

Means for supporting papers, forms and the like on the pin type feed mechanism of a computer printer or the like is provided which comprises a pair of flexible strips each having near one edge thereof a plurality of regularly spaced holes for engaging the sprockets of the pin type feed mechanism of a computer printer or the like, and near the other edge thereof a strip of non-setting, non-permanent adhesive for firmly, but removably, securing the said papers for advancement into the printer.

4 Claims, 1 Drawing Figure

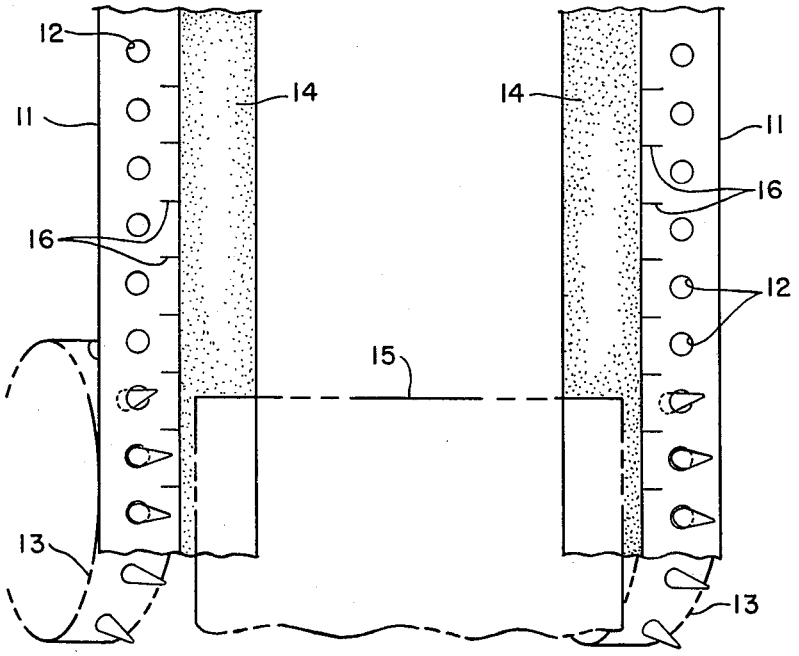
12
11
14
16
13
15
14
11
16
12
13

COMPUTER PRINTER PAPER SUPPORT

RIGHTS OF THE GOVERNMENT

The invention described herein may be manufactured and used by or for the Government of the United States for all governmental purposes without the payment of any royalty.

This is a continuation, of application Ser. No. 300,869, filed Sept. 10, 1981 now abandoned.

BACKGROUND OF THE INVENTION

This invention relates to pin type paper feed mechanisms for computer printers and the like, and more particularly to means for supporting sheet printing materials on a pin type feed mechanism for advancement through a printer, where friction feed is unavailable.

Pin type feed mechanisms for advancing paper through a computer printer, typewriter or the like are well known in the prior art and widely used in commercially available printer systems. Typically, the paper used in conjunction with these printer systems has on each side a plurality of regularly spaced holes configured to engage the sprockets on each side of the feed mechanism for advancement of the paper through the printer system. The size, style and configuration of the papers, forms and the like which are adaptable to the feed mechanisms of conventional printers are therefore limited, and the papers conventionally include the means for advancing them into the printer, such as perforated strips along the sides thereof.

The present invention provides means for supporting papers, forms and the like for advancement through a printer and which may be adapted for use in substantially any size pin type feeder mechanism of a conventional printer. A pair of flexible strips is provided, each having along one edge thereof a plurality of regularly spaced holes for engagement with the sprockets of the pin feed mechanism, and along the other edge a non-setting, non-permanent adhesive for supporting each edge of a sheet for advancement into the printer. Papers, forms, stationary and the like of substantially any size and configuration, and which are not provided with means for advancement into the printer, may therefore be supported for printing using the support means disclosed herein.

It is, therefore, an object of this invention to provide a means for supporting papers, forms and the like on the pin type feed mechanism of a computer printer or the like.

It is a further object of this invention to provide a means for supporting substantially any size sheet materials on the feed mechanism of a computer printer and the like.

It is a still further object of this invention to provide said support means adaptable to substantially any size printer.

These and other objects of the present invention will become apparent as the detailed description of certain preferred embodiments thereof proceeds.

SUMMARY OF THE INVENTION

In accordance with the foregoing principles and objects of the present invention, means for supporting papers, forms and the like on the pin type feed mechanism of a computer printer or the like is provided which comprises a pair of flexible strips each having near one edge thereof a plurality of regularly spaced holes for engaging the sprockets of the pin type feed mechanism of a computer printer or the like, and near the other edge thereof a strip of non-setting, non-permanent adhesive for firmly, but removably, securing the said papers for advancement into the printer.

DESCRIPTION OF THE DRAWINGS

The present invention will be more clearly understood from the following detailed description of certain specific embodiments thereof read in conjunction with the accompanying drawing which illustrates a pair of perforated strips of this invention with adhesive for supporting a paper, form or the like on the sprockets of a pin type feed mechanism.

DETAILED DESCRIPTION

Referring now to the drawing, illustrated therein is a preferred embodiment of the present invention which comprises a pair of perforated strips with adhesive for holding a sheet of paper in a desired orientation for feeding through a printer.

As shown in the drawing, the novel pin type feed paper support of this invention is illustrated as a pair of flexible strips 11, having a plurality of holes 12 regularly spaced along the length of each strip 11 and near one edge thereof. Strips 11 may comprise any suitable flexible material including paper, cloth or other fabrics, plastic, metal and composites or combinations and is therefore not critical to the invention so long as the material has sufficient strength and tear resistance to support a sheet of paper or the like for printing in a computer printer having a pin type feed mechanism. The diameter and spacing of holes 12 may be selected to receive the pins of sprockets 13 (shown by phantom lines) of any standard pin feed mechanism of a printing system.

Along the length of strips 11 near the edge opposite spaced holes 12 is provided a layer of non-setting, non-permanent adhesive 14 to firmly, but removably, hold onto strip 11 a sheet of paper or other sheet printing material, such as shown by phantom lines in the drawing as sheet 15. A wide range of adhesives, including many commercially available adhesives, may be suitable for use herein, and therefore adhesive selection is not limiting of this invention.

Strips 11, as shown in the drawing, are interchangeable and therefore the same configuration may be used on either side of the pin feed system represented by sprockets 13 with adhesive 14 areas positioned between sprockets 13. This configuration is preferable although a less preferred embodiment of strips 11 comprising one left-handed strip and one right-handed strip, each having alignment marks 16, as hereinafter described, which do not have uniform spacing like that suggested in the drawing, is contemplated hereunder.

Alignment marks 16 may be provided with any desired spacing along the length of strips 11, preferably near adhesive 14, to facilitate proper placement and alignment of sheet 15 on strips 11 preparatory to a printing operation.

It may be desirable in certain applications to provide strips 11 which are disposable and suitable for one-time use. However, in certain other applications, depending on the type of pin feed mechanisms and printer system used, it may be convenient or desirable to provide a set of perforated strips 11 each having its respective ends joined to provide an endless strip on which the printing material may be carried and which may be circulated through the printer for repetitive use.

In use, a sheet 15 of paper or the like may be secured to a pair of strips 11 by pressing sheet 15 against adhesive 14, substantially as shown in the drawing. The assembly may then be fed into the pin feed mechanism to perform a printing operation onto sheet 15. Once the printing operation is complete, sheet 15 may be easily lifted from adhesive 14. Alternatively, wherein a set of endless strips 11 are employed as discussed above, sheet 15 may be conveniently placed and aligned onto strips 11 which have been previously installed into the feed mechanism of the printer, and the printing operation performed substantially as stated above.

Tests were performed using the embodiment shown in the drawing in conjunction with two different commercially available pin feed type printers, both as a general test of utility and to determine if the invention could be used in conjunction with a printer wherein the sprockets 13 on each side of the pin feed mechanism were somewhat out of angular alignment with each other. A misalignment of at least ⅛ inch proved to be tolerable, resulting in satisfactory acceptance by the printer.

It is notable that the embodiment of the invention shown in the drawing may be used in a printer without regard to the width of the feed mechanism between sprockets 13.

There is, therefore, provided herein a novel means for supporting sheets of paper or the like on a pin feed mechanism within a computer printer or the like. The invention may be adaptable to any size printer or may accommodate any size sheet for printing. It is understood that certain modifications to the invention as hereinabove described may be made, as might occur to one with skill in the field of this invention, within the scope of the appended claims. Therefore, all embodiments contemplated hereunder have not been shown in complete detail. Other embodiments may be developed without departing from the spirit of the invention or from the scope of the appended claims.

I claim:

1. In a paper transport assembly for a printer having a pin type paper feed mechanism which includes a pair of spaced sprockets for advancement of various sizes and configurations of individual sheets of paper into said printer, said paper transport comprising:

a. a first flexible strip having along the length and near a first edge thereof a first plurality of regularly spaced holes for engaging the sprocket on a first side of said pin type feed mechanism, and a layer of non-setting and non-permanent adhesive means on said first strip along the length and near a second edge thereof, for removeably attaching said sheet along a first edge thereof to said first strip;

b. a second flexible strip having along the length and near a first edge thereof a second plurality of regularly spaced holes for engaging the sprocket on a second side of said pin type feed mechanism, and a layer of non-setting and non-permanent adhesive means on said second strip along the length and near a second edge thereof said first and second strips defining a width, between said first plurality of holes and said second plurality of holes of more than the width of said sheets of paper supportable thereon, for removably attaching said sheet along a second edge and opposite said first edge thereof to said second strip whereby said sheet is directly attached to and supported only on said first and second strip between said sprockets and is not otherwise provided with means for transport into said printer; and c. each of said layers of adhesive means having a width extending a predetermined distance from the second edges of said respective first and second strips towards the respective first and second pluralities of holes whereby said range of sizes and configurations of sheets transportable by said assembly is related to the combined width of said adhesive means.

2. The paper transport assembly as recited in claim 1 further comprising a plurality of regularly spaced alignment marks on each of said strips whereby said sheet may be accurately aligned on said strips between said sprockets for transport into said printer.

3. An improved printing material assembly for transport into a printer, having a pin type feed mechanism including a pair of spaced sprockets for advancement of various sizes and configurations of printing material into said printer, comprising:

a. a first flexible strip having along the length and near a first edge thereof a first plurality of regularly spaced holes for engaging the sprocket on a first side of said pin type feed mechanism b. a second flexible strip having along the length and near a first edge thereof a second plurality of regularly spaced holes for engaging the sprocket on a second side of said pin type feed mechanism;

c. a layer of non-setting and non-permanent adhesive on each of said strips along the length and near a second edge thereof each said adhesive layer having a width extending a predetermined distance from said respective second edges towards said respective first and second plurality of holes, whereby said range of sizes and configurations of printing material advancable by said assembly is related to the combined widths of said adhesive layers; and d. a sheet of paper having a width less than that defined between said first and second pluralities of holes, said sheet removably attached at respective opposite edges thereof to said strips at said adhesive layers, and directly supported on said strips, and not otherwise provided with means for transport by said sprockets of said pin type feed mechanism into said printer.

4. The printing material assembly as recited in claim 3 further comprising a plurality of regularly spaced alignment marks on said strips along the lengths thereof whereby said sheet may be accurately aligned on said strips between said sprockets for transport into said printer.

* * * * *